United States Patent [19]

Kobayashi et al.

[11] Patent Number: 5,010,601

[45] Date of Patent: Apr. 30, 1991

[54] MECHANISM FOR OPENING AND CLOSING TOILET SEAT AND COVER

[75] Inventors: Keiichi Kobayashi; Masazumi Moriwaki, both of Kitakyushu; Sigenari Kadomatsu, Yokohama; Yuji Fujie, Yokohama; Masanobu Kawamoto, Yokohama, all of Japan

[73] Assignees: Toto Ltd., Fukuoka; Nifco Inc., Kanagawa, both of Japan

[21] Appl. No.: 560,267

[22] Filed: Jul. 26, 1990

Related U.S. Application Data

[63] Continuation-in-part of Ser. No. 300,470, Jan. 23, 1989, abandoned.

[30] Foreign Application Priority Data

Jan. 26, 1988 [JP] Japan ..... 63-16149

[51] Int. Cl.[5] ..... A47K 13/12; A47K 13/10

[52] U.S. Cl. ..... 4/236; 4/251; 4/234

[58] Field of Search ..... 4/251, 236, 240; 16/50, 16/54, 68, 84, 297, 307, 342, 325

[56] References Cited

U.S. PATENT DOCUMENTS 2,214,323 9/1940 Carter ..... 4/251

4,491,989 1/1985 McGrail ..... 4/251

FOREIGN PATENT DOCUMENTS 3722114 1/1988 Fed. Rep. of Germany ..... 4/251

*Primary Examiner*—Ernest G. Cusick

*Assistant Examiner*—David J. Walczak

*Attorney, Agent, or Firm*—Jordan and Hamburg

[57] ABSTRACT

Apparatus for controlling pivotal movement of a pivotal member on a water closet includes a casing mounted on the water closet, a rotor rotatably mounted in the casing and viscous material interposed between the rotor and the casing providing relative rotational resistance between the rotor and the casing. A joint member coaxial with the rotor is provided and a spring clutch is operably disposed between the rotor and the joint member and operable to drive the rotor in one direction when the joint member is rotated in one direction while permitting the joint member to rotate in an opposite direction without driving the rotor member in such opposite direction. A shaft is connected to the pivotal member, the shaft being coaxial with the joint member. An interplay is interposed between the shaft and the joint member operable to permit the shaft to rotate a first angular amount in such one direction without driving the joint member and operable such that when the shaft continues to rotate further beyond such angular amount in such one direction, the shaft drives the joint member, whereby the pivot member attached to the shaft is freely rotatable in such one direction such first angular amount and thence further rotatable in such one direction to a closed position while being restrained by the viscous material, the pivot member being rotatable in such opposite direction from such closed position to an open position without being restrained by the viscous material.

23 Claims, 10 Drawing Sheets

MECHANISM FOR OPENING AND CLOSING TOILET SEAT AND COVER

This application is a continuation-in-part of application Ser. No. 300,470, filed Jan. 23, 1989 now abandoned.

BACKGROUND OF THE INVENTION

1. Field of the Invention

This invention relates to an opening and closing mechanism for the seat and cover which are provided on a stool.

2. Description of the Prior Art

For a flush toilet, a seat only or a seat with a closable cover is generally mounted, and that with the base end portion coupled to a stool body by a hinge mechanism is employed as the simplest structure.

The hinge mechanism consists of base end portions of the seat and cover connected to the stool body by a shaft such as pins or the like, and the seat and cover are coupled integrally or rotatably with the pins, thus rotating freely to a hinge part of the stool body.

However, in such a seat and cover working on a free rotation system, the seat and cover naturally fall shut when unhanded and thus cause a loud sound when striking the stool body; therefore care should particularly be taken when using it at night. Further, frequent shocks resulting on the stool body by the seat and cover may cause the hinge part to work loose, thus shortening the life of the product.

To solve such problems, there is provided a structure operating slowly by loading a rotation of the seat and cover on the hinge mechanism with a resistance.

For example, a structure wherein a coil spring is provided around a shaft of the hinge mechanism is disclosed in the specification and drawings of Japanese Utility Model Application No. 188910/1985, and thus if unhanded halfway before closing the seat and cover, the sudden fall is damped by the resilience of the coil spring, thus relieving the shock to the stool body. And, also, an opening and closing mechanism using a viscous damper or the like as the resisting means to the rotation of the hinge shaft has also been proposed.

However, the moment of rotational force about the hinge is slight immediately after the seat and cover start the inclination from the erected state, but increases with the angle toward the stool body, the torque working on the hinge changes, and the torque is maximized immediately before completely closing.

In the aforementioned structure wherein a rotation of the hinge mechanism is loaded with a resistance, the resistance works almost with a constant force to the operation of the seat and cover from the erected state to closing.

Thus, if a resistance value by rotation resisting means provided on the hinge mechanism is smaller than the maximum torque generated by the seat and cover, the damping capacity to the shock substantially becomes zero. Further, for the damping capacity to function, if the resistance value is given so as to be equal to the maximum torque or greater than that, the rotation resistance form erected state to closing increases excessively and the time is prolonged, which is not practical.

If a viscous damper is employed as a rotation resisting means for the hinge, it also works as a resistance at the time when the seat and cover are erected, thus requiring a large force compared with a conventional free rotation type.

To solve the aforementioned problem, it is effective to provide an opening and closing mechanism having a variable torque function capable of coping with a torque change about the hinge. However, a variable torque device employed as an opening and closing mechanism for the seat and cover in the prior art is complicated in structure and large in addition. Consequently, such a particular type as is enclosed in a casing such as a sanitary washing device or the like which is ancillary to the stool body is not acceptable particularly for installation.

Further, the defect is such that hinge mechanism for rotation of the seat and cover in the prior art requires excessive space, and where it is applied to the stool provided with a sanitary device for washing the private parts which is used extensively of late, another auxiliary mechanism or, for example, a mechanism for retaining an erected posture of the seat and cover can no more be provided.

SUMMARY OF THE INVENTION

To solve the problem on opening and closing the seat and cover which is inherent in the conventional flush toilet, an object of the invention is to provide an opening and closing mechanism not to hinder the serviceability, capable of realizing a damping function satisfactorily for bringing down the seat and cover from erected state, and holding the seat and cover upright securely.

An opening and closing mechanism for connecting at least one of the seat and cover closably to a stool according to the invention supports detachably a fitting shaft inserted in a mount provided on at least one base end of the seat and cover, which comprises a resistance mechanism for providing a turning resistance only at the time when at least one of the seat and cover is closed, a constraint mechanism for retaining at least one of the seat and cover at an erect position, a power transmission mechanism for compensating a change in turning force arising between the erect position and closing position.

The resistance mechanism for providing a turning resistance only at the time when at least one of the seat and cover is to be closed may be constructed so as to utilize a viscosity type clutch function.

In the opening and closing mechanism for seat and cover of the invention, construction is such that the resistance mechanism is not actuated when opening the seat and cover but operates slowly after turning quickly in a predetermined angle range for closing.

Accordingly, when the seat and cover are opened, these can be handled lightly as in the case of a normal seat and cover, and when closing, the operation can be closed within a short time despite loading with resistance. Further, a shock from the opening and closing mechanism to the stool side is relieved, and these members are prevented from damage, loose work and the like. Still further, the mechanism may be structured to allow the fitting shaft to be detached simply, therefore maintenance work is simplified, and the seat is kept clean and used sanitarily at all times.

BRIEF DESCRIPTION OF THE DRAWINGS

The accompanying drawings represent a preferred embodiment of the invention.

FIG. 5 (*b*) is a sectional view taken on line Vb—Vb of FIG. 5 (*a*);

FIG. 7 (*b*) is a plan view, partly cutaway, of the casing;

FIGS. 8 (*c*) and 8 (*d*) are perspective views illustrating the spring clutch function of the coil spring;

Further.

DETAILED DESCRIPTION OF PREFERRED EMBODIMENT

Figure 1:
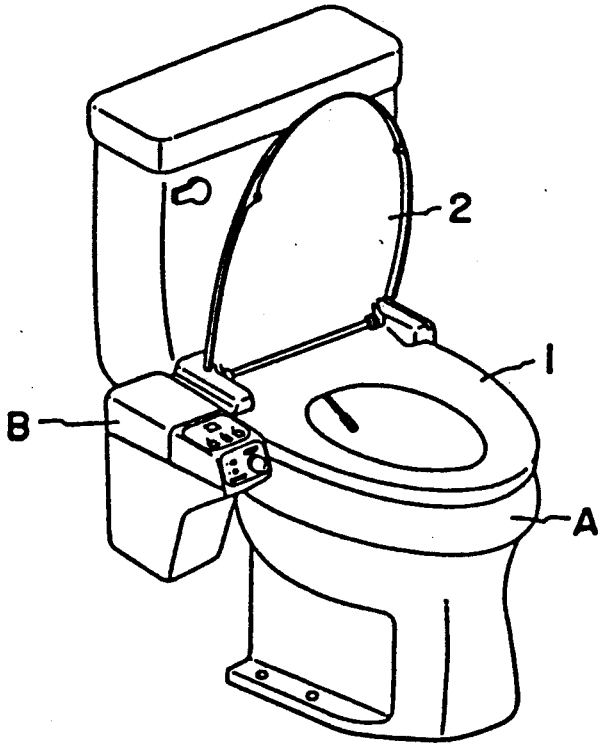
FIG. 1 and FIG. 2 show a state wherein a sanitary washing device B having a cleaning function is provided on a stool body A, and an opening and closing mechanism according to the invention is disposed within the casing.
Figure 2:
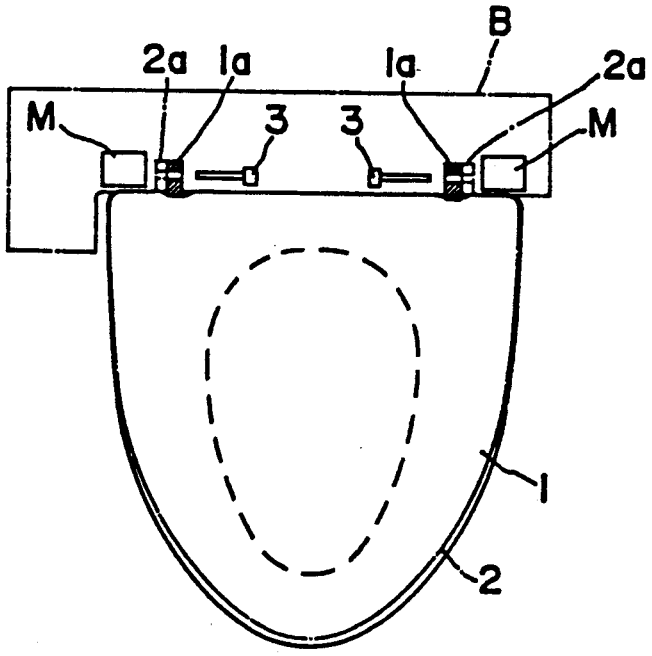

The embodiment relates to a construction wherein a sanitary washing device B having a cleaning function for the private parts is provided on a stool body A as shown in FIG. 1 and FIG. 2, an opening and closing mechanism is disposed within the casing, and a seat 1 and cover 2 are connected to the sanitary washing device B at left and right portions thereof respectively. A pair of mounts 1*a*, 2*a* connected to an opening and closing mechanism M are formed on each base end of the seat 1 and the cover 2, and the seat 1 and the cover 2 are connected to the opening and closing mechanisms M by means of the mounts 1*a*, 2*a* and fitting shafts 3.

Figure 5A:
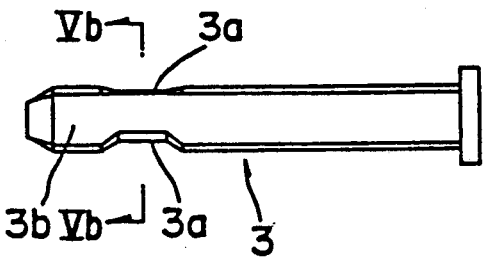
FIG. 5 (*a*) is a front view of a fitting shaft.
Figure 5B:
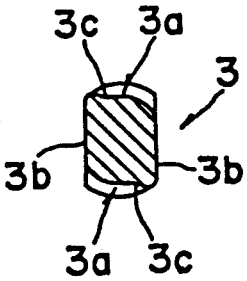
Figure 6A:
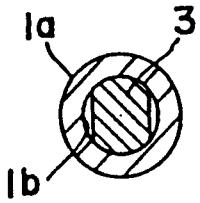
FIGS. 6 (*a*) to 6 (*d*) are sectional views showing the fitting shaft and a mount for the seat and cover.
Figure 6C:
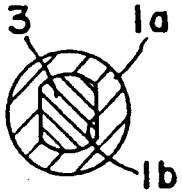
Figure 6B:
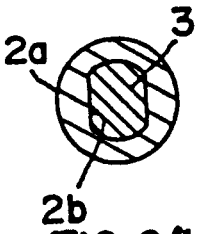
Figure 6D:
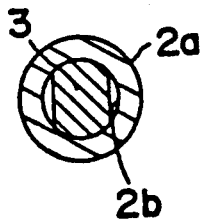

The fitting shaft 3 consists of a rod made of synthetic resin and a nose contracted as shown in FIG. 5 (*a*), and the section orthogonal to the line of axis is elliptic to have straight and curved profile as shown in FIG. 5 (*b*). Recesses 3*a* in point symmetry to the center of section are formed as a cam part on a peripheral surface of the portion inclined toward the nose from the axial center.

Sectional forms of insertion holes 1*b*, 2*b* of the mounts 1*a*, 2*a* for the seat 1 and the cover 2 in which the fitting shafts 3 are inserted vary depending on a horizontal disposition of the mounts 1*a*, 2*a* as shown in FIG. 6. That is, when mounts 1*a*, 2*a* are located on the right side in FIG. 2, the sectional form of the insertion hole 1*b* on the seat 1 side is a circle with a circular face of the fitting shaft 3 as the radius, as shown in FIG. 6 (*a*), (*b*), while the insertion hole 2*b* for the cover 2 has an elliptic section to which the fitting shaft 3 corresponds. When mounts 1*a*, 2*a* are located on the left side in FIG. 2, the fitting shaft 3 is fitted in the insertion hole 1*b* for the seat 1, and the insertion hole 2*b* for the cover 2 is circular in section as shown in FIG. 6 (*c*), (*d*).

According to such sectional forms of the insertion holes 1*b*, 2*b*, the seat 1 rotates freely round the fitting shaft 3 on the right side, and the cover 2 rotates together with the fitting shaft 3, while the seat 1 rotates together with the fitting shaft 3, and the cover 2 rotates regardless of the fitting shaft 3 on the left side.

Figure 7A:
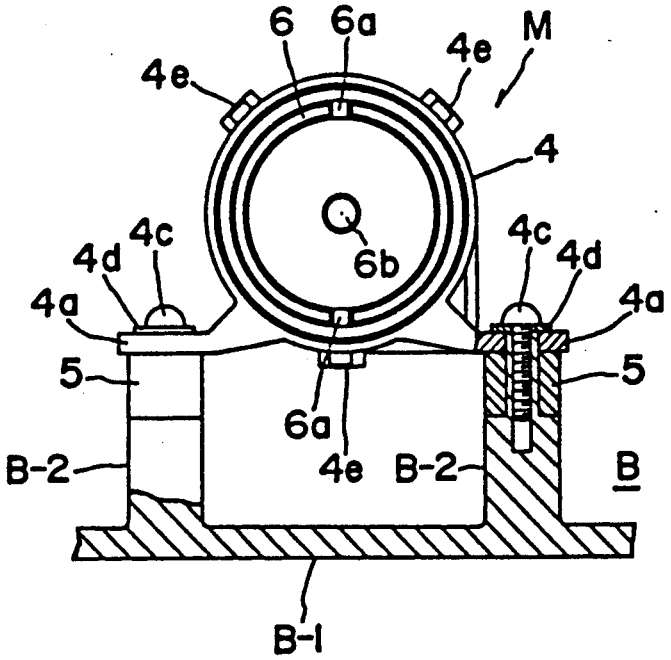
FIG. 7 (*a*) is a view, partly cutaway, showing a casing installation of the opening and closing mechanism.
Figure 7B:
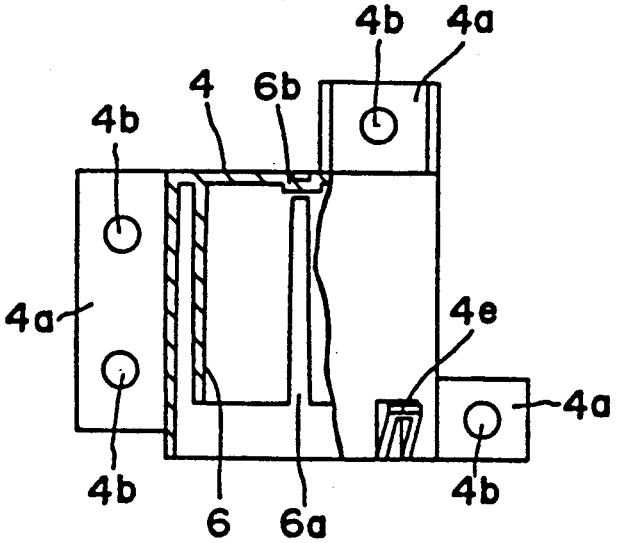
Figure 8C:
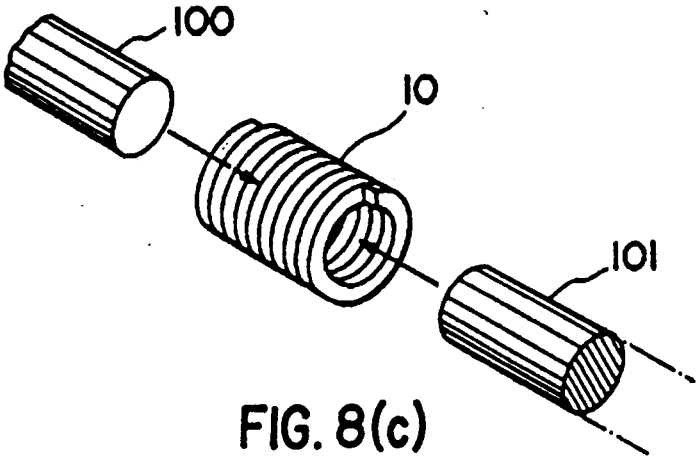
FIGS. 8 (*a*) and 8 (*b*) are perspective view of a coil spring having a clutch function.
Figure 8D:
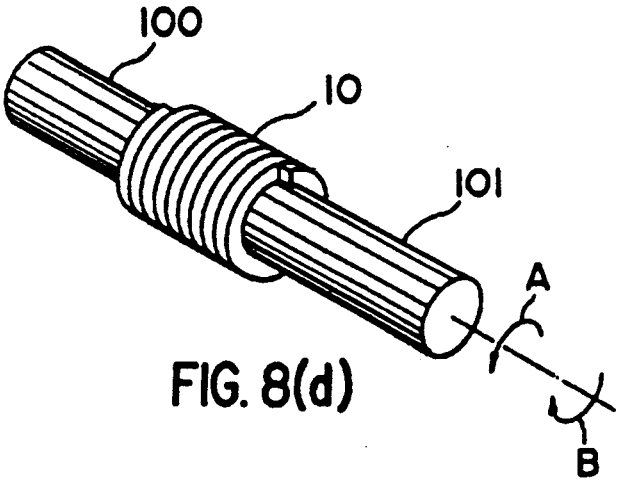
Figure 8A:
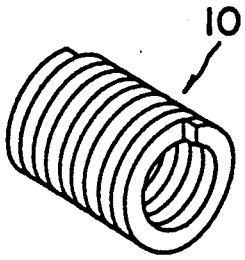
Figure 8B:
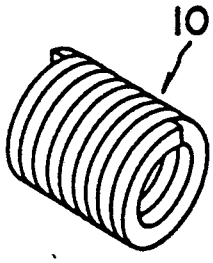
Figure 9A:
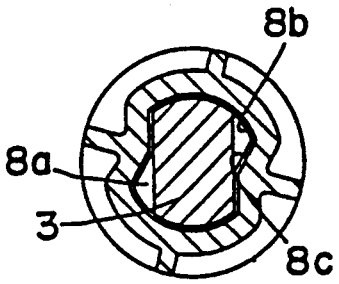
FIGS. 9 (*a*) to 9 (*d*) are sectional views showing a joint behavior according to a rotation of the fitting shaft taken along the line IX—IX in FIG. 3.
Figure 9B:
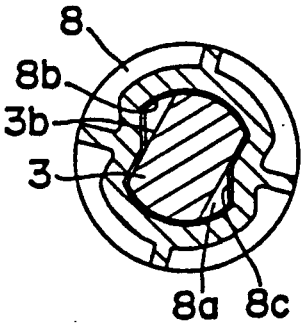
Figure 9C:
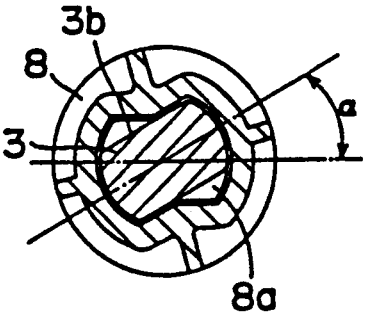
Figure 9D:
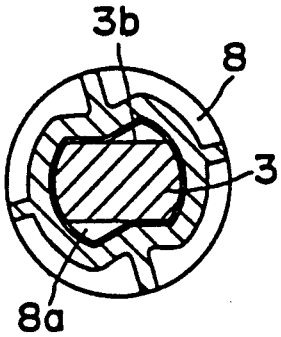

The opening and closing mechanism M consists of a casing 4 fixed on a base B-1 of the sanitary washing device B. A support boss B-2 for receiving a fixing piece 4*a* provided on the casing 4 is formed on the base B-1 at a predetermined position as shown in FIG. 7 (*a*), and its upper end enters a hole 4*b* of the fixing piece 4*a*. An elastic sleeve 5 supporting a lower surface of the fixing piece 4*a* is provided on the support boss B-2, and the elastic sleeve 5 is available for shock-absorbing. The casing 4 has its fixing piece 4*a* fixed on the support boss B-2 by means of a screw 4*c* and a washer 4*d*.

Accordingly, the opening and closing mechanism M can entirely be supported elastically on the sanitary washing device B by means of the sleeve 5 having a shock-absorber-function between the lower surface of the fixing piece 4*a* and the base B-1. Further, since the upper end of the support boss B-2 is inserted in the hole 4*b* of the fixing piece 4*a*, a positioning operation in assembling can be simplified.

As will be apparent from FIG. 7 (*b*), the casing 4 has a double-tube structure with an annular inner wall 6. A slit 6*a* running axially of the casing 4 is provided at the upper and lower portions in a longitudinal section of the inner wall 6, and a salience 6*b* which is circular in longitudinal section is projected axially at the center of the inside end wall of the casing 4.

Figure 3:
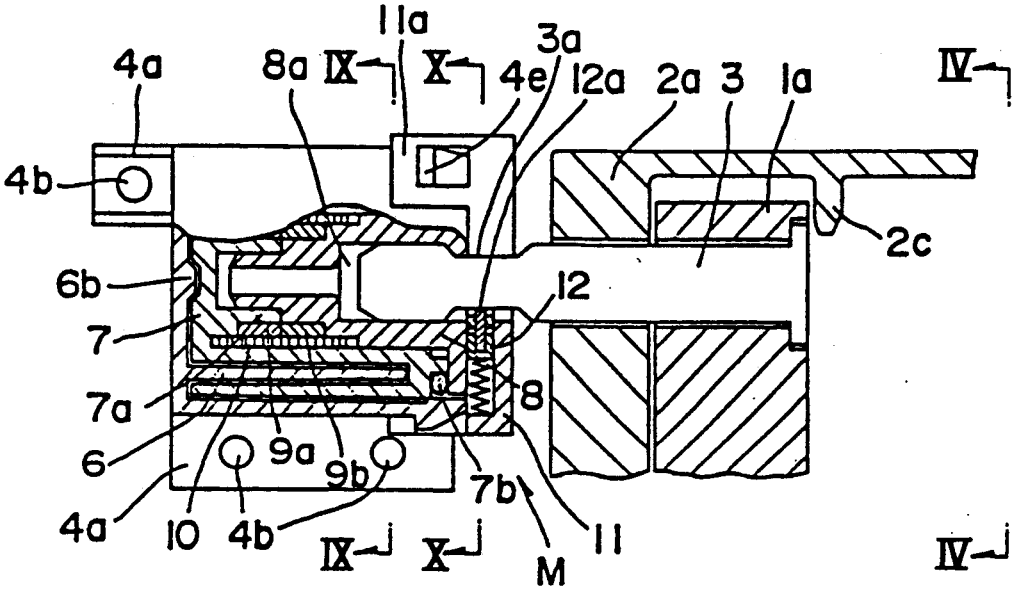
FIG. 3 is a plan view, partly cutaway, of the opening and closing mechanism of the invention.

Further, as shown in FIG. 3, a rotor 7 is disposed in the casing 4 which provides a resistance to rotation of the seat 1 and the cover 2 which is transmitted from the fitting shaft 3, and a joint 8 for connecting the fitting shaft 3 to the opening and closing mechanism M is also disposed in the casing 4.

The rotor 7 provides a resistance when the seat 1 and the cover 2 are closed, thus functioning as a resistance mechanism, enabling a damped closing operation. That is, the rotor 7 has a double-tube structure with a two-layer wall standing between an inner peripheral wall of the casing 4 and the inner wall 6, and filling up an inner peripheral side of the inner wall 6. A tubular rib 7*a* is formed at the center of the interior of the rotor 7 so as to be coaxial with the casing 4. An O-ring 7*b* is provided between the casing 4 and the joint 8, a closed space is provided between the inner peripheral wall of the casing 4 and inner and outer walls of the inner wall 6, and grease or the like is charged therein. The grease is charged entirely on the inner wall 6 and between the inner peripheral wall of the casing 4 and the rotor 7, and the viscosity of the grease functions as a resistance to rotation of the rotor 7 to the casing 4.

The joint 8 has its nose portion inserted in the rib 7*a* of the rotor 7, and the joint 8 and the rotor 7 are rotatably independently. The outside diameter of the rib 7*a* and the outside diameter on the nose side of the joint 8 are formed to be equal, and a portion joining with an end portion of the rib 7a is provided with metallic rings 9a, 9b. The rings 9a, 9b have outside diameters equal to that of the rib 7a, a coil spring 10 is fitted between a base end of the rib 7a and a halfway portion of the joint 8, and a junction through the coil spring 10 is utilized as a clutch mechanism.

The coil spring 10 is wound counterclockwise (spirally counterclockwise centrally of the line of axis of the spring) as shown in FIG. 8 (a), and is incorporated in the opening and closing mechanism M in the left side in FIG. 2. A wire such as heat-treated steel or the like which constitutes the coil spring 10 is suitably flat in section. Further, the coil spring 10 would clockwise (spirally clockwise centrally of the line of axis of the spring) as shown in FIG. 8 (b) is incorporated in the opening and closing mechanism M in the right side in FIG. 2.

Thus, when raising the seat 1 and/or the cover 2, the rotation of the fitting shaft 3 will not be transmitted to the rotor 7 by providing the coil springs 10 on the opening and closing mechanisms M. That is, when the opening and closing mechanism M is located in the left side in FIG. 3, the fitting shaft 3 rotates clockwise when viewed from the center of the seat 1 and the cover 2, and the coil spring 10 is loaded with a working force counter to the winding direction of the coil spring 10. As a result, the coil spring 10 is expanded in its inner diameter, transmission of the turning force between the joint 8 and the rotor 7 is collapsed due to slipping between the coil spring 10 and the rotor, and thus the rotation is not transmitted from the fitting shaft 3 to the rotor 7. Also, when the opening and closing mechanism M is positioned in the right side in FIG. 2, the fitting shaft 3 rotates counterclockwise when viewed from the center of the seat 1 and the cover 2. The coil spring 10 is loaded with a working force which is counter to the winding direction of the coil spring, therefore due to the expansion of the inner diameter of the coil spring 10 slip arises likewise, and the rotation cannot be transmitted.

FIGS. 8 (c) and 8 (d) illustrate the general principle underlying the spring clutch function of coil spring 10.

As shown in FIGS. 8 (c) and 8 (d), coil spring 10 has a circular inner wall in its axial direction so that, as shown in FIG. 8 (c), a pair of rods, for example, can be inserted into both ends of the annular opening of the spring 10. When the rods 100 and 101 have a cylindrical shape with a diameter approximately equal to the inner diameter of the coil spring 10, the rods tightly fit into the annular opening of the coil spring 10 as shown in FIG. 8 (d).

In this manner, the rods 100 and 101 are interconnected through the coil spring 10, and the rods 100, 101 and the coil spring 10 are operatively combined in a coaxial arrangement.

As shown in FIG. 8 (d), if the one rod 100 is fixed to be at rest and the other rod 101 is forced to be rotated in the direction of arrow A, the friction between the outer periphery of the rod 101 and the inner surface of the coil spring 10 operates to wind up the spiral element of the coil spring 10. Therefore, the coil spring 10 shrinks in diameter to tighten against the circumferential surface of the rod 101. Accordingly, the rod 101 is interconnected to the other rod 100 by means of radially elastic deformation of the coil spring.

On the other hand, when the rod 101 is forced to be rotated in the direction of arrow B, the coil spring 10 returns to its original state, thus weakening its tightening force against the rod 101.

The above is the manner in which rods 100 and 101 are interconnected through the coil spring 10. This principle is the principle applied to the construction of the rotor 7, the joint 8 and the coil spring 10 of the present invention. Namely, the rib 7a of the rotor and the cylindrical portion of the joint 8 are tightly fitted into opposite ends of the annular opening of the coil spring 10 together with the metallic rings 9a and 9b. In this manner, the rotor 7 and joint 8 are interconnected through the coil spring 10, whereby the rotor 7, joint 8 and coil spring 10 are operatively combined in a coaxial arrangement. With such a construction, depending on the rotational direction of the joint 8, the rotational movement of the joint 8 is either transmitted to the rotor 7 through frictional engagement with the coil spring 10, or, during the rotation of the joint 8, the rotor 7 remains at rest. Thus, the operative combination of the rotor 7, the joint 8 and the coil spring 10 provides a spring clutch function between the joint 8 and the rotor 7.

As mentioned above, since the behavior of the coil spring 10 when the joint 8 is forced to be rotated enables the joint 8 and the rotor 7 to be interconnected, the coil spring 10 does not require or employ additional connecting members to interconnect the joint 8 and the rotor 7.

FIG. 9 (a) is a longitudinal sectional view of the joint 8 which is taken on line III—III of FIG. 3.

An insertion hole 8a in which a nose portion of the fitting shaft 3 is inserted is formed axially on the joint 8. The insertion hole 8a has an opening sectional form whereby the fitting shaft 3 having an almost elliptic section can be turned freely by a predetermined angle round its axis. That is, since a pair of curved portions 8b having a form equal to that of a circular portion of the fitting shaft 3 and a pair of segmentary linear portions 8c are formed, the fitting shaft 3 is allowed to have a play of predetermined angle around the axis as shown in FIG. 9 (a) and (b). Accordingly, if the fitting shaft 3 rotates within the range of angles included in the play, the rotation of the fitting shaft 3 will not be transmitted to the joint 8. When linear portions of the fitting shaft 3 come in contact with the linear portions 8c of the insertion hole 8a (as shown in FIG. 9 (c), (d), the joint 8 rotates together with the rotation of the fitting shaft 3.

Figure 4:
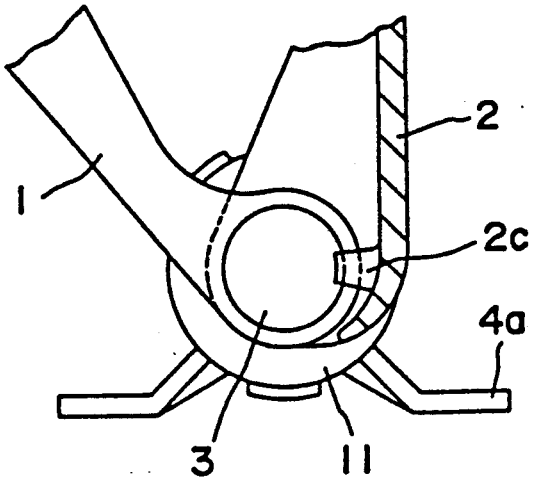
FIG. 4 is a view taken on line IV—IV of FIG. 3.

Further, a locking cap 11 for the fitting shaft 3 is detachably attached to the casing 4 so as to be coaxial with the joint 8. As shown in FIG. 3 and FIG. 4, the locking cap 11 consists of an annular member provided with a hook 11a engaging with a claw 4e projecting on a peripheral surface of the casing 4.

Figure 10A:
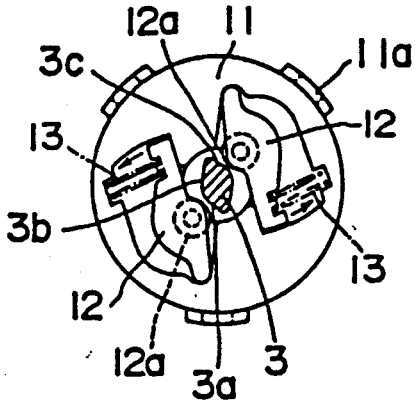
FIG. 10 is a sectional views showing an arrangement of the fitting shaft and a locking cap taken along the line X—X in FIG. 3.
Figure 10B:
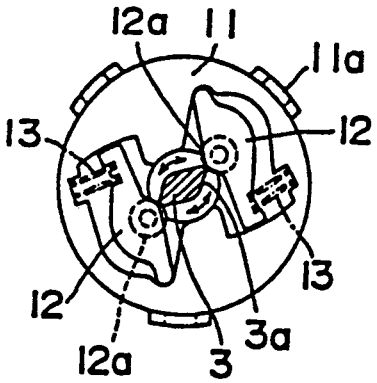
Figure 10C:
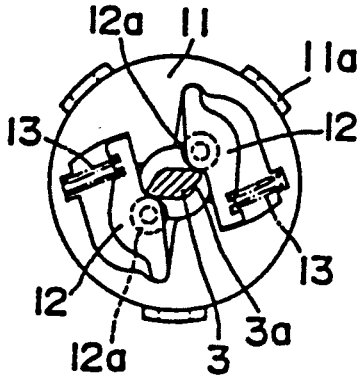

As shown in FIG. 10 (a), a pair of locking pieces 12 for constraining the peripheral surface of the recess 3a of the fitting shaft 3, and roller pieces 12a incorporated rotatably therein for minimizing wear of the contact face are contained within the locking cap 11. The locking pieces 12 have their base ends pivoted rotatably on the locking cap 11 and thus are rotatable in the direction indicated by an arrow in the drawing. A spring 13 for energizing the locking piece 12 to the peripheral of the fitting shaft 3 is connected thereto, and rotation of the fitting shaft 3 is loaded with a resistance due to the energizing force.

When the fitting shaft 3 is inserted into the joint 8 through the locking cap 11, the recess 3a of the fitting shaft 3 is set to a position corresponding to that of the roller pieces 12a of the locking pieces 12 of the locking cap 11, as shown in FIG. 3. As shown in FIG. 5 (*b*), the recess 3a of the fitting shaft 3 has the linear portions 3b and the curved portions 3c, and the linear portions 3b are sandwiched between the roller pieces 12a as shown in FIG. 10. Thus, when the linear portions of the fitting shaft 3 face the roller pieces 12a in position, the rotation of the fitting shaft 3 is constrained. Accordingly, the locking cap 11 may function as a constraint mechanism for holding the seat 1 at a position where the seat 1 should be erected.

Another opening and closing mechanism M including the aforementioned elements is disposed in the right side in FIG. 2. In this case, the relationship between the insertion holes 1b, 2b of the mounts 1a, 2a for the seat 1 and the cover 2 and the fitting shaft 3 is described with reference to FIG. 6 (*a*) and (*b*). However, the constraint mechanism is not required for the cover, and hence the locking pieces 12 and the roller pieces 12a are not incorporated in the locking cap 11. However, other mechanisms are all the same as those on the left side.

In the above-described construction where the cover 2 only is erected, the fitting shaft 3 is fitted in the insertion hole 2b of the mount 2a in the right side as shown in FIG. 6 (*b*), while it is fitted loosely therein on the left side, therefore the fitting shaft 3 of the opening and closing mechanism M in the right side rotates together with the cover 2. That is, in erecting the cover 2 only, only the opening and closing mechanism M in the right side contributes to actuation, and the cover 2 is rotatable around the fitting shaft 3 connected to the opening and closing mechanism M in the left side. On the other hand, the fitting shaft 3 for the seat 1 is shown in FIG. 9 and FIG. 10. FIG. 10 (*a*) and FIG. 10 (*b*) indicate the case where the seat 1 is closed, and the linear portion 3b of the fitting shaft 3 is vertical.

When the seat 1 is erected from the closed state, the fitting shaft 3 rotates clockwise in FIG. 9 (*a*) and FIG. 10 (*a*). In this case, the recess 3a of the fitting shaft 3 pushes the locking pieces 12 and the roller pieces 12a to continue the turning of the fitting shaft 3, and the nose portion inserted in the joint 8 changes the posture as shown in FIG. 9 (*b*). That is, since the insertion hole 8a of the joint 8 has a play to the fitting shaft 3, the rotation will not be transmitted to the joint 8 until the linear portion 3b of the fitting shaft 3 comes in contact with the linear portion 8c of the insertion hole 8a as shown in FIG. 9 (*b*). Accordingly, such load as is necessary for the recess 3a to rotate against the spring 13 is sufficient for the cover 2 to start opening, thus ensuring light handling.

When the seat 1 is raised further, the turning force is transmitted to the joint 8, which is ready for turning. On the other hand, the coil spring 10 of the opening and closing mechanism M in the left side is wound counterclockwise when viewed from the center of the seat 1. Accordingly, since the joint 8 rotates clockwise, the coil spring 10 is loaded with a working force which is counter to the direction in which it is wound in a circumferential direction concurrently with a rotation of the joint 8. As a result, the inner diameter of the coil spring 10 becomes large, a fitting-in degree to the joint 8 and the rotor 7 decreases, and the transmission of the turning force therebetween is stopped.

Thus, by utilizing a deformation of the coil spring 10, the joint 8 idles in the casing 4, and the fitting shaft 3 will not be loaded with a resistance caused by the casing 4 and the rotor 7. Accordingly, no resistance will work when the seat 1 is opened, thus enabling an easy operation to erect the seat 1 in position. In the opening and closing mechanism M on the right side, the fitting shaft 3 is rotatable in the insertion hole 1b of the mount 1a as shown in FIG. 6 (*a*), therefore it rotates freely at the time when the seat 1 is turned.

When the seat 1 is erected, the roller pieces 12a of the locking pieces 12 of the locking cap 11 come in contact with the linear portions 3b of the fitting shaft 3 as shown in FIG. 10 (*c*). The roller pieces 12a hold the linear portions 3b therebetween with energizing force of the spring 13, and constrain a rotation of the fitting shaft 3 by means of the moment of rotational force of the seat 1. Thus the seat 1 is retained at its erected position and ready for self-supporting. Accordingly, the seat 1 can stand still at a proper angle of erection.

When closing the seat 1, the seat 1 is to be depressed with force enough to release the constraint of the fitting shaft 3 due to the roller pieces 12a. In this case, the fitting shaft 3 rotates counterclockwise in FIG. 9 (*d*) and FIG. 10 (*c*).

The seat 1 moves quickly, without being subjected to a resistance caused by the casing 4 and the rotor 7, down to a predetermined angle from the point of erection according to the existence of a play between the joint 8 and the fitting shaft 3. That is, through the period from the state of FIG. 9 (*d*) to that of (*c*), the fitting shaft 3 rotating together with the seat 1 idles in the joint 8 because of the form of the insertion hole 8a in the joint 8. As shown in FIG. 9 (*c*), rotation from the fitting shaft 3 is transmitted to the joint 8 when the linear portions 3b of the fitting shaft 3 come in contact with the linear portions 8c of the insertion hole 8a. Accordingly, in a domain with angle $\alpha$ shown in FIG. 9 (*c*), the seat 1 moves in a manner of a natural fall and turns quickly in the direction of closing without being subjected to a resistance. Further, after reaching the state of FIG. 9 (*c*), the joint 8 is rotated counterclockwise by means of the fitting shaft 3. In this case, the coil spring 10 disposed against the rotor 7 receives the working force in the winding direction from the peripheral surface of the joint 8. Accordingly, the coil spring 10 is deformed to have the inner diameter reduced, and pushes strongly each fitted portion of the joint 8 and the rotor 7, and thus a turning force can be transmitted from the joint 8 to the rotor 7. When the rotor 7 turns in the casing 4, a resistance caused by the grease enclosed therein works. As a result, the seat 1 turns quickly in the domain with angle $\alpha$, while the seat 1 is decelerated thereafter due to the resistance to an approximately constant low speed, and then falls slowly to reach the upper surface of the stool body A.

Thus, when closing the seat 1, it rotates quickly in a predetermined range of angle from the erected state and falls slowly thereafter. Accordingly, the time for closing the seat 1 is shortened as compared with a construction wherein the resistance works always through closing motion. In the movement of the seat 1 to the surface of the stool body A, since the resistance caused by the casing 4 and the rotor 7 works, the seat 1 can move slowly. Thus, a shock will not occur on the seat 1 and hence a loud sound will not be produced, and a smooth and gentle operation can be conducted consequently.

Further, when raising both the seat 1 and the cover 2 together, a similar operation to that in the above description is realized according to a function of the opening and closing mechanisms M. Needless to say, the seat 1 assumes a similar behavior to the above description.

The cover 2 performs a damping action for closing in the right side opening and closing mechanism M.

The cover 2 has the fitting shaft 3 fitted in the insertion hole 2*b* of the mount 2*a* as shown in FIG. 6 (*b*), and the seat 1 is rotatable with reference to the fitting shaft 3 as shown in FIG. 6 (*a*). Thus, the right side opening and closing mechanism M controls only operation of the cover 2, and its behavior is exactly the same as that for the seat 1. That is, when raising the cover 2, resistance is removed by expansion of the inner diameter of the coil spring 10, and when closing, it moves quickly at first but is subjected to a resistance caused by the casing 4 and the rotor 7 before running toward the seat 1, thus closing gently.

Further, in case the seat 1 only is closed while the cover 2 remains erected, the opening and closing mechanism M in the left side operates. Since the fitting shaft 3 is rotatable with reference to the insertion hole 1*b* in the right side of the seat 1 as shown in FIG. 6 (*a*), the right side opening and closing mechanism M does not interlock with the operation of the seat 1. It goes without saying that the seat 1 may be related to interlocking with the opening and closing mechanism M in the right side, and the cover 2 may be related to interlocking with that in the left side because of the relationship between the fitting shaft 3 and the insertion holes 1*b*, 2*b* for the seat 1 and the cover 2.

Further, the fitting shaft 3 has its end surface constrained by a projection 2*c* provided on the cover 2 as shown in FIG. 3 and FIG. 4.

Still further, the opening and closing mechanism M is fixed on the base B-1 by means of the sleeve 5 having a damping function. Accordingly, shocks and so on due to the operation of the seat 1 and the cover 2 are absorbed, and vibrations affecting the sanitary washing device B can be damped. Thus, an impact on the equipments provided on the sanitary washing device B is reduced, and a loose work of members can be eliminated thereby.

Figure 11A:
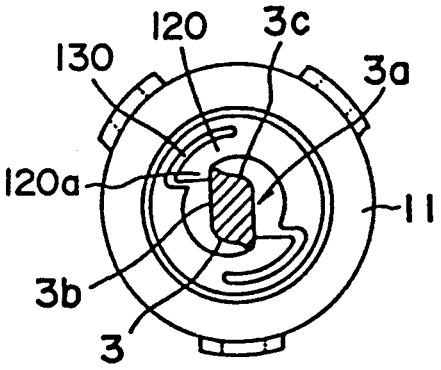
FIGS. 11 (*a*) and 11 (*b*) show another embodiment of locking means for the fitting shaft.
Figure 11B:
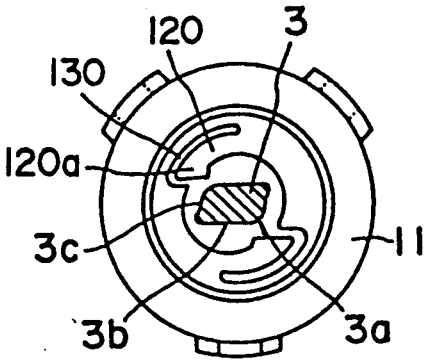

Another embodiment of the construction of the constraint mechanism is illustrated in FIG. 11. The locking cap 11 is provided with a pair of locking arms 120 at the inner periphery thereof. A slit 130 separates each locking arm 120 from the inner body of the locking cap 11, so that the locking arms 120 may be elastically deformed in the radial direction. The locking arm 120 has an engaging portion 120*a* at the inner side of the distal end thereof which engages the linear portion 3*b* of the fitting shaft 3 shown in FIG. 16 (*a*) to regulate the rotation of the fitting shaft 3. When the fitting shaft 3 is forced to rotate counterclockwise in FIG. 11 (*a*), the linear portion 3*b* pushes the engaging portion 120*a* to deform the locking arm 120 outwardly, and subsequently the fitting shaft 3 rotates without being constrained due to the locking arms 120 as shown in FIG. 11 (*a*). On the other hand, when the fitting shaft 3 rotates clockwise in FIG. 11 (*b*), the curved portion 3*c* pushes the distal inner end portion of the locking arm 120, so that the fitting shaft 3 may rotate and move into the state of locking shown in FIG. 11 (*a*).

Such a construction of the constraint mechanism can perform locking function for the fitting shaft 3 as well as that in the embodiment shown in FIG. 10.

Another mode than the above-described embodiment may be employed as a structure for providing the seat 1 and the cover 2. The embodiment is described with reference to FIG. 12 to FIG. 16.

Figure 12:
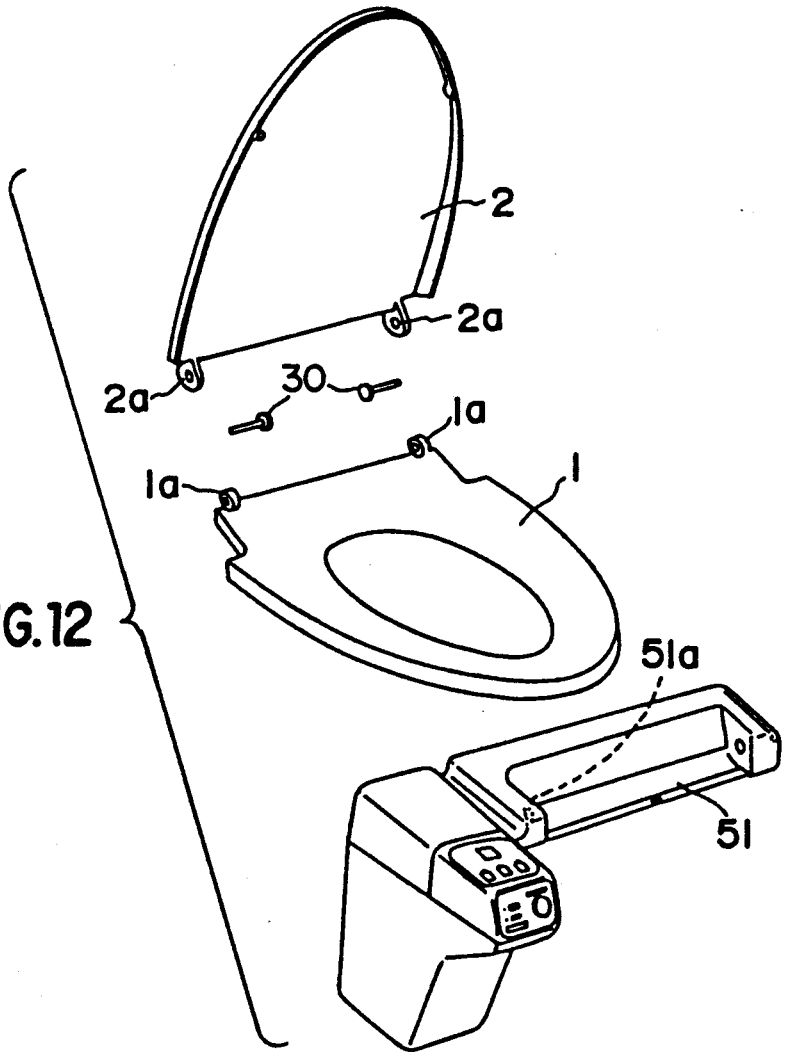
FIG. 12 is an exploded perspective view showing a mounting of the seat and cover on the sanitary washing device.

In FIG. 12, the seat 1 and the cover 2 are fitted rotatably by inserting fitting shafts 30 into pivoting holes 51*a* of a casing 51 of the sanitary washing device.

Figure 14:
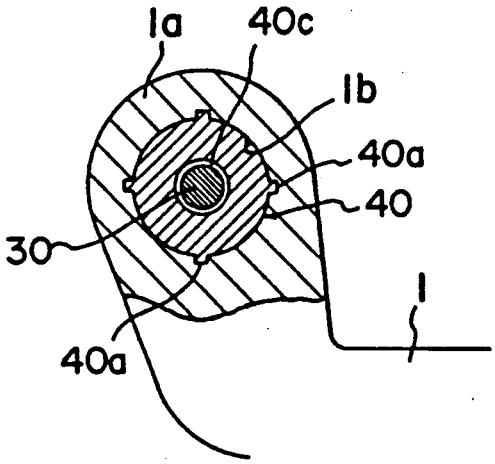
FIG. 14 is a sectional view taken on line XIV—XIV of FIG. 13.

The seat 1 as well as the mounts 1*a* is made of synthetic resin such as ABS or the like, and a bushing 40 for supporting the fitting shaft 30 thereon is unified with the mount 1*a*. Since a synthetic resin has mechanical strength, the bushing 40 can be incorporated in the hole 1*b* provided on the mount 1*a* by use of insertion works. As shown in FIG. 14, a plurality of ridges 40*a* are provided on the peripheral surface of the bushing 40, and are engaged in the hole 1*b*, thereby constraining rotation of the bushing 40.

Figure 15:
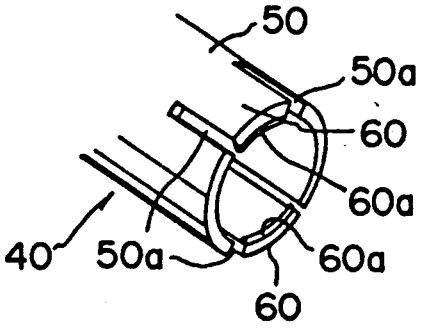
FIG. 15 is a perspective view showing a locking piece portion of a bush.

Further, a side of the bushing 40 facing the center of the seat 1 forms an open cavity 40*b*, and an insertion hole 40*c* of the fitting shaft 30 communicates with the cavity 40*b*. A tubular portion 50 is formed integrally with the cavity 40*b* so as to be coaxial with the insertion hole 40*c*. Four slits 50*a* are provided axially on a nose of the tubular portion 50 as shown in FIG. 15, and a pair of slits with a minor length in the circumferential direction are made to function as locking pieces 60 for the fitting shaft 30. The locking pieces 60 are positioned opposite each other radially, and a projection 60*a* is provided on the inner periphery of each nose protrusively toward the center.

Figure 13:
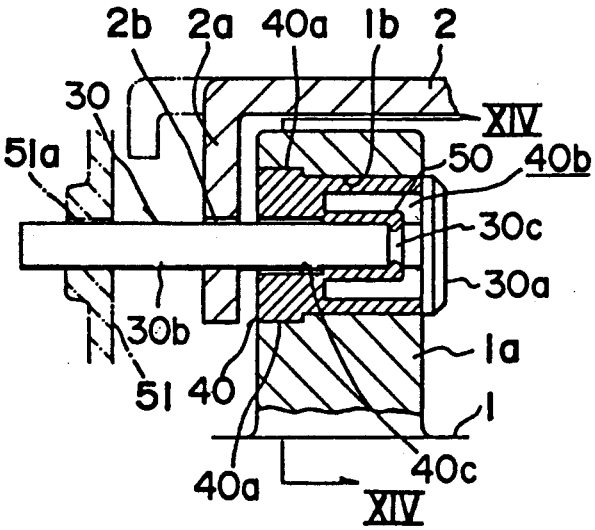
FIG. 13 is a longitudinal sectional view showing a main part of a mounting structure.

On the other hand, the fitting shaft 30 is provided with a flange 30*a* at one end thereof which is seated on an end surface of the bushing 40, and a groove 30*c* is formed in the circumferential direction on a the shaft part 30*b* near the flange 30*a*. The groove 30*c* is formed at a position where the projection 60*a* of the locking piece 60 may come in when the flange 30*a* is seated on the end surface of the bushing 40 as shown in FIG. 13. The nose of the fitting shaft 30 passes through the bushing 40 to reach the hole 2*b* provided on the cover 2, and the fitting shaft 30 is supported within the hole 51*a* of the washing device 51.

Figure 16A:
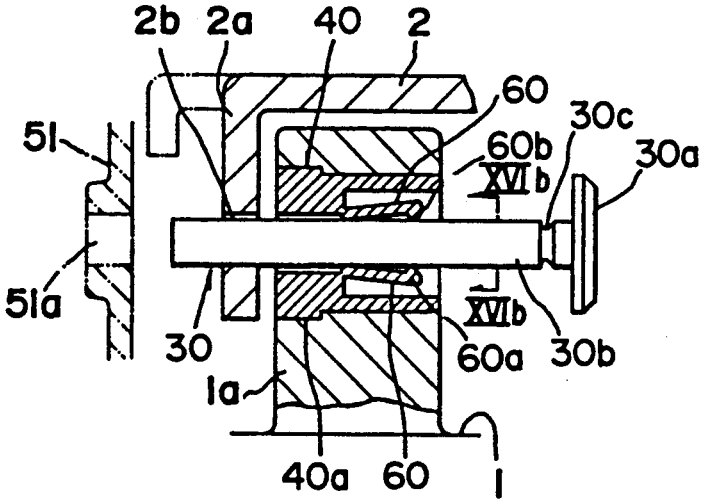
FIGS. 16 (*a*) and 16 (*b*) are sectional views showing a deformation of the locking piece due to an insertion of the fitting shaft, FIG. 16 (*b*) being a sectional view taken along the line XVIb—XVIb in FIG. 16 (*a*).
Figure 16B:
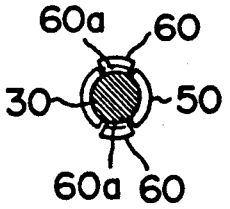

In the above-described construction, the mounts 1*a*, 2*a* are set in position, and the fitting shaft 30 is inserted in the bushing 40 as shown in FIG. 16 (*a*) to couple the seat 1 and the cover 2 to the washing device 51. In this case, the locking piece 60 is deformed elastically by the shaft part 30*b* of the fitting shaft 30 to expand outward as shown in FIG. 16 (*a*) and (*b*) (a sectional view taken on line VI—VI of FIG. 15 (*a*)). A relief is prepared with a nose of the projection 60*a* of the locking piece 60 as a tapered face 60*b* so as to allow smooth insertion of the fitting shaft 30.

When the nose of the fitting shaft 30 comes into the hole 51*a* of the washing device 51 and the flange 30*a* is seated on an end surface of the bushing 40, the projection 60*a* of the locking piece 60 engages with the groove 30*c* as shown in FIG. 13. Accordingly, the fitting shaft 30 is regulated against axial movement by means of the locking piece 60, and thus can be prevented from ejection.

As described above, the seat 1 and the cover 2 can be coupled simply by inserting the fitting shaft 30 in the bush 40 provided with the locking piece 60 to be deformed elastically. Thus, a mechanical means such as a screw or the like is not required, and hence it is ready for installation simply and manufactured very easily. When removing off the fitting shaft 30, it can be detached simply by raising the flange 30*a* by means of a screwdriver or the like and disengaging the projection 60*a* and the groove 30*c*. Accordingly, it is easy to handle and the stool is clean to ensure a comfortable use at all times.

In the above-described embodiment, the seat and the cover are coupled to the washing device. In addition, the fitting structure according to this invention can be applied also to directly couple the seat and cover to the stool body where these are coupled directly by using a hinge mechanism. Further, the fitting structure can be applied likewise to a stool provided with the seat only.

The opening and closing mechanism for the seat and cover according to this invention may be applied not only to the stool having a sanitary equipment as exemplified in the above-described embodiment but also to a stool having various forms.

What is claimed is:

1. Apparatus for controlling pivotal movement of a pivotal member on a water closet comprising casing means mounted on said water closet, a rotor means rotatably mounted in said casing means, viscous material means interposed between said rotor means and said casing means providing relative rotational resistance between said rotor means and said casing means, a joint means coaxial with said rotor means, spring clutch means operably disposed between said rotor means and said joint means and operable to drive said rotor means in one direction when said joint means is rotated in one direction while permitting said joint means to rotate in an opposite direction without driving said rotor means in said opposite direction, shaft means connected to said pivotal member, said shaft means being coaxial with said joint means, and interplay means interposed between said shaft means and said joint means operable to permit said shaft means to rotate an angular amount in said one direction without driving said joint means and operable such that when said shaft means continues to rotate further beyond said angular amount in said one direction, said shaft means drives said joint means, whereby said pivot member attached to said shaft means is freely rotatable in said one direction said angular amount and thence further rotatable in said one direction to a closed position while being restrained by said viscous material means, said pivot member being rotatable in said opposite direction from said closed position to an open position without being restrained by said viscous material means.

2. Apparatus according to claim 1 wherein said casing means has an outer cylindrical wall portion and an inner cylindrical wall portion spaced from said outer cylindrical wall portion to define a first annular space therebetween, said rotor means having an outer cylindrical wall section and an inner cylindrical wall section spaced from said outer wall section to define a second annular space therebetween, said inner wall portion of said casing means being disposed in said second annular space, said outer cylindrical section of said rotor means being disposed in said first annular space, said viscous material means being disposed in said first and second annular spaces between said inner and outer cylindrical wall portions and between said inner and outer cylindrical wall sections.

3. Apparatus according to claim 2 wherein said outer and inner cylindrical wall portions and said outer and inner cylindrical wall sections are coaxial with said rotor means.

4. Apparatus according to claim 3 wherein said casing means has a longitudinal end wall, said outer and inner cylindrical wall portions extending integrally from said end wall, said rotor means having a longitudinal end wall spaced from said end wall of said casing means, said outer and inner cylindrical wall sections extending integrally from said end wall of said rotor means.

5. Apparatus according to claim 1 wherein said rotor means has rotatable support means for rotatably supporting said joint means.

6. Apparatus according to claim 1 wherein said rotor means has an axis of rotation and said spring clutch means comprises a coil spring coaxial with said axis of rotation.

7. Apparatus according to claim 1 wherein said interplay comprises an opening in said joint means and a section of said shaft means disposed in said opening, said opening having a first pair of opposed parallel flat sides and a second pair of opposed parallel flat sides, said shaft section having opposed parallel flat faces, said shaft means being freely rotatable in said opening between one position wherein said first pair of flat sides of said opening engages first parts of each flat face of said shaft and another position wherein said second pair of flat sides of said opening engage second parts of each flat face of said shaft.

8. Apparatus according to claim 7 wherein said first pair of flat sides are joined to said second pair of flat sides along diametrically opposed juncture lines.

9. Apparatus according to claim 8 wherein one of said flat sides of said first pair and one of said flat sides of said second pair are connected to one another at one of said lines of juncture with a generally V-shaped configuration.

10. Apparatus according to claim 7 wherein said first pair of flat sides is angularly spaced from said second pair of flat sides by said angular amount.

11. Apparatus according to claim 1 further comprising constraining means on said casing means operable to engage said shaft means and hold said pivotal member in an erect position corresponding to said open position.

12. Apparatus according to claim 11 wherein said shaft means has a shaft portion having a peripheral surface formed with juxtaposed linear and curved portions, said constraining means comprising biasing means biased into contact with said peripheral surface.

13. Apparatus according to claim 12 wherein said biasing means comprises pivotal locking levers and springs biasing said locking levers into biasing contact with said peripheral surface.

14. Apparatus according to claim 12 wherein said biasing means comprises a locking arm having a ring portion and arm portions integrally formed with said ring portion, said arm portions being flexibly movable relative to said ring portion, said ring portion being in biasing contact with said peripheral surface.

15. Apparatus according to claim 11 further comprising attachment means for detachably attaching said constraining means to said casing means.

16. Apparatus according to claim 11 wherein said constraining means comprises an annular locking cap coaxial with said rotor means, and hook and claw means attaching said locking annular cap to said casing means.

17. Apparatus according to claim 1 wherein said pivotal member is a seat for said water closet.

18. Apparatus according to claim 1 wherein said pivotal member is a cover for said water closet.

19. Apparatus according to claim 1 wherein said viscous material means comprises grease having a viscosity which functions as a resistance against relative rotation between said rotor means and said casing means.

20. Apparatus for controlling pivotal movement of a pivotal member on a water closet comprising casing means mounted on said water closet, a rotor means rotatably mounted in said casing means, said casing means having an outer cylindrical wall portion and an inner cylindrical wall portion spaced from said outer cylindrical wall portion to define a first annular space therebetween, said rotor means having an outer cylindrical wall section and an inner cylindrical wall section spaced from said outer wall section to define a second annular space therebetween, said inner wall portion of said casing means being disposed in said second annular space, said outer cylindrical section of said rotor means being disposed in said first annular space, viscous material means disposed in said first and second annular spaces between said inner and outer cylindrical wall portions and between said inner and outer cylindrical wall sections providing relative rotational resistance between said rotor means and said casing means, a joint means coaxial with said rotor means, clutch means operably disposed between said rotor means and said joint means and operable to drive said rotor means in one direction when said joint means is rotated in one direction while permitting said joint means to rotate in an opposite direction without driving said rotor means in said opposite direction, shaft means connected to said pivotal member, said shaft means being coaxial with said joint means, and interplay means interposed between said shaft means and said joint means operable to permit said shaft means to rotate an angular amount in said one direction without driving said joint means and operable such that when said shaft means continues to rotate further beyond said angular amount in said one direction, said shaft means drives said joint means, whereby said pivot member attached to said shaft means is freely rotatable in said one direction said angular amount and thence further rotatable in said one direction to a closed position while being restrained by said viscous material means, said pivot member being rotatable in said opposite direction from said closed position to an open position without being restrained by said viscous material means.

21. Apparatus for controlling pivotal movement of a pivotal seat and a pivotal cover on a water closet comprising first casing means mounted on said water closet, a first rotor means rotatably mounted in said first casing means, first viscous material means interposed between said first rotor means and said first casing means providing relative rotational resistance between said first rotor means and said first casing means, a first joint means coaxial with said first rotor means, first spring clutch means operably disposed between said first rotor means and said first joint means and operable to drive said first rotor means in one direction when said first joint means is rotated in one direction while permitting said first joint means to rotate in an opposite direction without driving said first rotor means in said opposite direction, first shaft means connected to said seat, said first shaft means being coaxial with said first joint means, first interplay means interposed between said first shaft means and said first joint means operable to permit said first shaft means to rotate a first angular amount in said one direction without driving said first joint means and operable such that when said first shaft means continues to rotate beyond said first angular amount in said one direction, said first shaft means drives said first joint means, whereby said seat is freely rotatable in said one direction said first angular amount and thence further rotatable in said one direction to a seat closed position while being restrained by said first viscous material means, said seat being rotatable in said opposite direction from said seat closed position to a seat open position without being restrained by said first viscous material, a second casing means mounted on said water closet, a second rotor means rotatably mounted in said second casing means, second viscous material means interposed between said second rotor means and said second casing means providing relative rotational resistance between said second rotor means and said second casing means, second joint means coaxial with said second rotor means, second spring clutch means operably disposed between said second rotor means and said second joint means and operable to drive said second rotor means in said one direction when said second joint means is rotated in said one direction while permitting said second joint means to rotate in said opposite direction without driving said second rotor means in said opposite direction, second shaft means connected to said second pivotal member, said second shaft means being coaxial with said second joint means, and second interplay means interposed between said second shaft means and said second joint means operable to permit said second shaft means to rotate a second angular amount in said one direction without driving said second joint means and operable such that when said second shaft means continues to rotate beyond said second angular amount in said one direction, said second shaft means drives said second joint means, whereby said cover is freely rotatable in said one direction said second angular amount and thence further rotatable in said one direction to a cover closed position while being restrained by said second viscous material means, said cover being rotatable in said opposite direction from said cover closed position to a cover open position without being restrained by said second viscous material means.

22. Apparatus according to claim 21 wherein said first casing means is axially spaced from said second casing means.

23. Apparatus according to claim 21 further comprising first mount means rotatably mounting said cover on said first shaft means, and second mount means rotatably mounting said seat on said second shaft means.

* * * * *